US008002910B2

(12) United States Patent
Tivelli et al.

(10) Patent No.: US 8,002,910 B2
(45) Date of Patent: Aug. 23, 2011

(54) SEAMLESS STEEL TUBE WHICH IS INTENDED TO BE USED AS A GUIDE PIPE AND PRODUCTION METHOD THEREOF

(75) Inventors: Marco Mario Tivelli, Veracruz (MX); Alfonso Izquierdo Garcia, Veracruz (MX); Dionino Colleluori, Veracruz (MX); Guiseppe Cumino, Veracruz (MX)

(73) Assignees: Tubos De Acero De Mexico S.A. (MX); Dalmine S.p.A. (IT)

( * ) Notice: Subject to any disclaimer, the term of this patent is extended or adjusted under 35 U.S.C. 154(b) by 452 days.

(21) Appl. No.: 10/554,075

(22) PCT Filed: Apr. 25, 2003

(86) PCT No.: PCT/MX03/00038

§ 371 (c)(1),
(2), (4) Date: Sep. 6, 2006

(87) PCT Pub. No.: WO2004/097059

PCT Pub. Date: Nov. 11, 2004

(65) Prior Publication Data

US 2007/0089813 A1 Apr. 26, 2007

(51) Int. Cl.
*C22C 38/44* (2006.01)
*C21D 8/10* (2006.01)
*C21D 9/08* (2006.01)

(52) U.S. Cl. ..... 148/335; 148/519; 148/590; 420/109

(58) Field of Classification Search ..... 148/519, 148/590, 909, 320–337; 420/89–93, 104–114, 420/119, 123–124, 127
See application file for complete search history.

(56) References Cited

U.S. PATENT DOCUMENTS 3,810,793 A 5/1974 Heller
4,231,555 A 11/1980 Saito
(Continued)

FOREIGN PATENT DOCUMENTS

AR 0050159 A1 10/2006
(Continued)

OTHER PUBLICATIONS

H. Howells ad S.A. Hatton. Challenges for ultra-deep water riser systems, IIR, London, Apr. 1997, 11 pages).*

(Continued)

*Primary Examiner* — George Wyszomierski
*Assistant Examiner* — Mark L Shevin
(74) *Attorney, Agent, or Firm* — Knobbe Martens Olson & Bear, LLP

(57) ABSTRACT

The present invention pertains to steel with high mechanical resistance at room temperature and up to 130° C., good toughness and good corrosion resistance in the metal base as well as good resistance to cracking in the heat affected zones (HAZ) once the tubing is welded together, and more specifically to heavy gauge seamless steel tubing with high mechanical resistance, good toughness and good corrosion resistance called catenary conduit. The advantages of the present invention with respect to those of an the state of technology reside in providing a chemical composition for steel used to manufacture heavy gauge seamless steel tubing with high mechanical resistance, good toughness, good fissure resistance in the HAZ and good corrosion resistance and a process for manufacturing this product. These advantages are obtained by using a composition made up basically of Fe and a specific chemical composition.

21 Claims, 3 Drawing Sheets

U.S. PATENT DOCUMENTS

| | | | | |
|---|---|---|---|---|
| 4,336,081 | A | 6/1982 | Hijikata et al. | |
| 4,376,528 | A | 3/1983 | Ohshimatani et al. | |
| 4,379,482 | A | 4/1983 | Suzuki et al. | |
| 4,407,681 | A | 10/1983 | Ina et al. | |
| 4,526,628 | A | 7/1985 | Ohno et al. | |
| 4,721,536 | A | 1/1988 | Grob et al. | |
| 4,814,141 | A | 3/1989 | Imai et al. | |
| 5,352,406 | A | 10/1994 | Barteri et al. | |
| 5,454,883 | A | 10/1995 | Yoshie et al. | |
| 5,538,566 | A | 7/1996 | Gallagher | |
| 5,592,988 | A | 1/1997 | Meroni et al. | |
| 5,598,735 | A | 2/1997 | Saito et al. | |
| 5,944,921 | A | 8/1999 | Cumino et al. | |
| 6,030,470 | A | 2/2000 | Hensger et al. | |
| 6,188,037 | B1 | 2/2001 | Hamada et al. | |
| 6,196,530 | B1 | 3/2001 | Muhr et al. | |
| 6,217,676 | B1 | 4/2001 | Takabe et al. | |
| 6,267,828 | B1 | 7/2001 | Kushida et al. | |
| 6,311,965 | B1 | 11/2001 | Muhr et al. | |
| 6,384,388 | B1 | 5/2002 | Anderson et al. | |
| 6,648,991 | B2 | 11/2003 | Turconi et al. | |
| 6,682,610 | B1 | 1/2004 | Inoue | |
| 6,958,099 | B2 | 10/2005 | Nakamura et al. | |
| 7,074,283 | B2 | 7/2006 | Omura | |
| 7,083,686 | B2 | 8/2006 | Itou | |
| 7,264,684 | B2 | 9/2007 | Numata et al. | |
| 7,635,406 | B2 | 12/2009 | Numata et al. | |
| 7,744,708 | B2 | 6/2010 | Lopez et al. | |
| 7,862,667 | B2 | 1/2011 | Turconi et al. | |
| 2002/0011284 | A1 | 1/2002 | Von Hagen et al. | |
| 2003/0155052 | A1 | 8/2003 | Kondo et al. | |
| 2004/0118490 | A1 | 6/2004 | Klueh et al. | |
| 2004/0131876 | A1 | 7/2004 | Ohgami et al. | |
| 2004/0139780 | A1 | 7/2004 | Cai et al. | |
| 2005/0076975 | A1 | 4/2005 | Lopez et al. | |
| 2005/0087269 | A1 | 4/2005 | Merwin | |
| 2006/0169368 | A1 | 8/2006 | Lopez et al. | |
| 2006/0243355 | A1 | 11/2006 | Haiderer et al. | |
| 2007/0089813 | A1 | 4/2007 | Tivelli | |
| 2007/0137736 | A1 | 6/2007 | Omura et al. | |
| 2007/0216126 | A1 | 9/2007 | Lopez et al. | |
| 2008/0047635 | A1* | 2/2008 | Kondo et al. | 148/541 |
| 2008/0129044 | A1 | 6/2008 | Carcagno et al. | |
| 2008/0219878 | A1* | 9/2008 | Kondo et al. | 420/83 |
| 2008/0226396 | A1 | 9/2008 | Garcia et al. | |
| 2008/0314481 | A1 | 12/2008 | Garcia et al. | |
| 2009/0010794 | A1 | 1/2009 | Turconi et al. | |
| 2009/0101242 | A1 | 4/2009 | Lopez et al. | |
| 2010/0068549 | A1 | 3/2010 | Agazzi et al. | |
| 2010/0136363 | A1 | 6/2010 | Valdez et al. | |
| 2010/0193085 | A1 | 8/2010 | Garcia et al. | |
| 2010/0294401 | A1 | 11/2010 | Gomez et al. | |
| 2010/0319814 | A1 | 12/2010 | Perez et al. | |
| 2010/0327550 | A1 | 12/2010 | Lopez | |

FOREIGN PATENT DOCUMENTS

| | | | |
|---|---|---|---|
| EP | 0 092 815 | | 11/1983 |
| EP | 0 658 632 | | 6/1995 |
| EP | 0 658 632 | A | 6/1995 |
| EP | 0 753 595 | | 1/1997 |
| EP | 0 828 007 | A | 3/1998 |
| EP | 0 989 196 | | 3/2000 |
| EP | 01027944 | B1 | 8/2000 |
| EP | 1 277 848 | | 1/2003 |
| EP | 1 288 316 | | 3/2003 |
| EP | 1 413 639 | | 4/2004 |
| EP | 1 717 324 | | 11/2006 |
| JP | 60-086209 | | 5/1985 |
| JP | 61270355 | | 11/1986 |
| JP | 63004046 | A2 | 1/1988 |
| JP | 63004047 | A2 | 1/1988 |
| JP | 63230847 | A2 | 9/1988 |
| JP | 63230851 | A2 | 9/1988 |
| JP | 01 259124 | A2 | 10/1989 |
| JP | 01 259125 | A2 | 10/1989 |
| JP | 01 283322 | A2 | 11/1989 |
| JP | 05-098350 | | 12/1990 |
| JP | 403006329 | A | 1/1991 |
| JP | 04 021718 | A2 | 1/1992 |
| JP | 04 107214 | | 4/1992 |
| JP | 04 231414 | A2 | 8/1992 |
| JP | 05 287381 | A2 | 11/1993 |
| JP | 06-093339 | | 4/1994 |
| JP | 06 172859 | A2 | 6/1994 |
| JP | 07 041856 | A2 | 2/1995 |
| JP | 07 197125 | A2 | 8/1995 |
| JP | 08 311551 | | 11/1996 |
| JP | 09 067624 | A2 | 3/1997 |
| JP | 09-235617 | * | 9/1997 |
| JP | 09-235617 | A * | 9/1997 |
| JP | 10 140250 | | 5/1998 |
| JP | 10176239 | | 6/1998 |
| JP | 10 280037 | A | 10/1998 |
| JP | 11 050148 | A | 2/1999 |
| JP | 11140580 | | 5/1999 |
| JP | 11229079 | | 8/1999 |
| JP | 2000-063940 | | 2/2000 |
| JP | 2000-313919 | A2 | 11/2000 |
| JP | 2001-131698 | | 5/2001 |
| JP | 2001-164338 | | 6/2001 |
| JP | 2001-172739 | A2 | 6/2001 |
| JP | 2001-271134 | | 10/2001 |
| JP | 2002-096105 | A2 | 4/2002 |
| JP | 2004-011009 | | 1/2004 |
| KR | 0245031 | | 3/2000 |
| WO | WO 96/22396 | | 7/1996 |
| WO | WO 00/70107 | | 11/2000 |
| WO | WO-00/70107 | A | 11/2000 |
| WO | WO 01/88210 | | 11/2001 |
| WO | WO 03/033856 | | 4/2003 |
| WO | WO 2004/031420 | | 4/2004 |
| WO | WO 2004/097059 | A1 | 11/2004 |
| WO | WO 2007/017161 | | 2/2007 |
| WO | WO 2008/003000 | | 1/2008 |
| WO | WO 2008/127084 | A2 | 10/2008 |
| WO | WO 2009/044297 | | 4/2009 |

OTHER PUBLICATIONS

R. K. Aggarwal et al. Qualification of solutions for improving fatigue life at SCR tough down zone, Deep Offshore Technology Conference, Nov. 8-10, 2005, Vitoria, Espirito Santo, Brazil, 12 pages.*

A. Izquierdo et al. Qualification of Weldable X65 Grade Riser Sections with Upset ends to Improve Fatigue Performance of Deepwater Steel Catenary Risers. Proceedings of the Eighteenth International Offshore and Polar Engineering Conference, Vancouver, BC, Canada, Jul. 6-11, 2008, p. 71.*

Tenaris Newletter for Pipeline Services, May 2003, p. 1-8.*

Tenaris Newletter for Pipeline Services, Apr. 2005, p. 1-8.*

R. Thethi and D. Walters. Alternative Construction for High Pressure High Temperature Steel Catenary Risers. OPT USA, Sep. 2003, p. 1-13.*

U.S. Appl. No. 08/972,870, filed Nov. 11, 1997, and its ongoing prosecution history, including without limitation Office Actions, Amendments, Remarks, and any other potentially relevant documents.

U.S. Appl. No. 12/042,145, filed Mar. 4, 2008, (published as 2009/0010794 A1) and its ongoing prosecution history, including without limitation Office Actions, Amendments, Remarks, and any other potentially relevant documents.

U.S. Appl. No. 12/073,879, filed Mar. 11, 2008, (published as 2008/0226396) and its ongoing prosecution history, including without limitation Office Action, Amendments, Remarks, and any other potentially relevant documents.

U.S. Appl. No. 11/997,900, filed Jun. 18, 2008, (published as 2008/0314481 A1) and its ongoing prosecution history, including without limitation Office Action, Amendments, Remarks, and any other potentially relevant documents.

U.S. Appl. No. 12/595,167, filed Aug. 2, 2010, (published as 2010/0193085 A1) and its ongoing prosecution history, including without limitation Office Action, Amendments, Remarks, and any other potentially relevant documents.

U.S. Appl. No. 12/979,058, filed Dec. 27, 2010 and its ongoing prosecution history, including without limitation Office Actions, Amendments, Remarks, and any other potentially relevant documents.
"Seamless Steel Tubes for Pressure Purposes-Technical Delivery Conditions-Part 1: Non-alloy Steel Tubes with Specified Room Temperature Properties" British Standard BS EN 10216-1:2002 E:1-26, published May 2002.
"Seamless Steel Tubes for Pressure Purposes-Technical Delivery Conditions-Part 3: Alloy Fine Grain Steel Tubes" British Standard BS EN 10216-3:2002 +A1:2004 E: 1-34, published Mar. 2004.
"Seamless Steel Tubes for Pressure Purposes-Technical Delivery Conditions-Part 4: Non-alloy and Alloy Steel Tubes with Specified Low Temperature Properties" British Standard BS EN 10216-4:2002 +A1:2004 E:1-30, published Mar. 2004.
"Seamless Steel Tubes for Pressure Purposes-Technical Delivery Conditions-Part2: Non-alloy and Alloy Steel Tubes with Specified Elevated Temperature Properties" British Standard BS EN 10216-2:2002+A2:2007:E:1-45, published Aug. 2007.
Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.
Asahi, et al., Development of Ultra-high-strength Linepipe, X120, Nippon Steel Technical Report, Jul. 2004, Issue 90, pp. 82-87.
ASM Handbook, Mechanical Tubing and Cold Finishing, Metals Handbook Desk Edition, (2000), 5 pages.
Bai, M., D. Liu, Y. Lou, X. Mao, L. Li, X. Huo, "Effects of Ti addition on low carbon hot strips produced by CSP process", Journal of University of Science and Technology Beijing, 2006, vol. 13, N° 3, p. 230.
Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.
Berner, Robert A., "Tetragonal Iron Sulfide", Science, Aug. 31, 1962, vol. 137, Issue 3531, pp. 669.
Berstein et al.,"The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.
Boulegue, Jacques, "Equilibria in a sulfide rich water from Enghien-les-Bains, France", Geochimica et Cosmochimica Acta, Pergamom Press, 1977, vol. 41, pp. 1751-1758, Great Britain.
Cancio et al., "Characterization of microalloy precipitates in the austenitic range of high strength low alloy steels", Steel Research, 2002, vol. 73, pp. 340-346.
Carboni, A., A. Pigani, G. Megahed, S. Paul, "Casting and rolling of API X 70 grades for artic application in a thin slab rolling plant", Stahl u Eisen, 2007, N° 1, p. 45-50.
Chang, L.C., "Microstructures and reaction kinetics of bainite transformation in Si-rich steels " XP0024874, Materials Science and Engineering, vol. 368, No. 1-2, Mar. 15, 2004, pp. 175-182, Abstract, Table 1.
Clark, A. Horrell, "Some Comments on the Composition and Stability Relations of Mackinawite", Neues Jahrbuch fur Mineralogie, 1966, vol. 5, pp. 300-304, London, England.
D.O.T. 178.65 Spec. 39, pp. 831-840, Non reusable (non refillable) cylinders, Oct. 1, 2002.
Davis, J.R., et al. "ASM—Speciality Handbook—Carbon and alloy steels" ASM Speciality Handbook, Carbon and Alloy Steels, 1996, pp. 12-27, XP002364757 US.
De Medicis, Rinaldo, "Cubic FeS, a Metastable Iron Sulfide", Science, American Association for the Advancement of Science, Steenbock Memorial Library, Dec. 11, 1970, vol. 170, Issue 3963, pp. 723-728.
Echaniz, "The effect of microstructure on the KISSC of low alloy carbon steels", Nace Corrosion '98, EE. UU., Mar. 1998, pp. 22-27, San Diego.
Echaniz, G., Morales, C., Perez, T., "Advances in Corrosion Control and Materials in Oil and Gas Production" Papers from Eurocorr 97 and Eurocorr 98, 13, P. S. Jackman and L.M. Smith, Published for the European Federation of Corrosion, No. 26, European Federation of Corrosion Publications, 1999.
Gojic, Mirko and Kosec, Ladislav, , "The Susceptibility to the Hydrogen Embrittlement of Low Alloy Cr and CrMo Steels", ISIJ International, 1997, vol. 37, Issue 4, pp. 412-418.
Heckmann, et al., Development of low carbon Nb-Ti-B microalloyed steels for high strength large diameter linepipe, Ironmaking and Steelmaking, 2005, vol. 32, Issue 4, pp. 337-341.
Howells, et al.: "Challenges for Ultra-Deep Water Riser Systems", IIR, London, Apr. 1997, 11 pages.
Iino et al., "Aciers pour pipe-lines resistant au cloquage et au criquage dus a l'hydrogene", Revue de Metallurgie, 1979, vol. 76, Issue 8-9, pp. 591-609.
Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.
Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.
Jacobs, Lucinda and Emerson, Steven, "Trace Metal Solubility in an Anoxid Fjord", Earth and Planetary Sci. Letters, Elsevier Scientific Publishing Company, 1982, vol. 60, pp. 237-252, Amsterdam, Netherlands.
Keizer, Joel, "Statistical Thermodynamics of Nonequilibrium Processes", Spinger-Verlag, 1987.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Morice et al., "Moessbauer Studies of Iron Sulphides", J. lnorg. Nucl. Chem., 1969, vol. 31, pp. 3797-3802.
Mullet et al., "Surface Chemistry and Structural Properties of Mackinawite Prepared by Reaction of Sulfide Ions with Metallic Iron", Geochemica et Cosmochemica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
Nagata, M., J. Speer, D. Matlock, "Titanium nitride precipitation behavior in thin slab cast high strength low alloyed steels", Metallurgical and Materials Transactions A, 2002, vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
PCT International Search Report re App. No. PCT/MX/03/00038, dated Nov. 3, 2003, in 2 pages.
Pressure Equipment Directive 97/23/EC, May 29, 1997, downloaded from website: http://ec.europa.eu/enterprise/pressure_equipment/ped/index_en.html on Aug. 4, 2010.
Prevéy, Paul, et al., "Introduction of Residual Stresses to Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Tempuratures", Stockholm Contrib. Geol., 1969, vol. 26, pp. 67-95.
Riecke, Ernst and Bohnenkamp, Konrad, "Uber den Einfluss von Gittersoerstellen in Eisen auf die Wassersroffduffusion", Z. Metallkde.., 1984, vol. 75, pp. 76-81.
Shanabarger, M.R. and Moorhead, R. Dale, "H2O Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A.Dasgupta, R.Bommaraju, "Characterization of the chemical interactions during casting of High-titanium low carbon enameling steels", 1991 Steelmaking Conference Proceeding, pp. 707-717.

Spry, Alan, "Metamorphic Textures", Perganom Press, 1969, New York.
Taira et al., "HIC and SSC Resistance of Line Pipes for Sour Gas Service", Nippon Kokan Technical Report, 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris Newsletter for Pipeline Services, Apr. 2005, p. 1-8.
Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Todoroki, T. Ishii, K. Mizuno, A. Hongo, "Effect of crystallization behavior of mold flux on slab surface quality of a Ti-bearing Fe-Cr-Ni super alloy cast by means of continuous casting process", Materials Science and Engineering A, 2005, vol. 413-414, p. 121-128.
Vaughan, D. J. and Ridout, M.S., "Moessbauer Studies of Some Sulphide Minerals", J. lnorg Nucl. Chem., 1971, vol. 33, pp. 741-746.
Wegst, C.W., "Stahlüssel", Auflage 1989, Seite 119, 2 pages.

* cited by examiner

Figure 3

| Reference | Composition | Austenitizing Temperature | Tempering Temperature | Steel |
|---|---|---|---|---|
| | | (°C) | (°C) | |
| 1 | NO Ti | 920 | 630 | A |
| 2 | NO Ti | 920 | 630 | B |
| 3 | NO Ti | 920 | 630 | C |
| 4 | NO Ti | 920 | 630 | D |
| 5 | NO Ti | 920 | 660 | A |
| 6 | NO Ti | 920 | 660 | B |
| 7 | NO Ti | 920 | 660 | C |
| 8 | NO Ti | 920 | 660 | D |
| 9 | NO Ti | 920 | 690 | A |
| 10 | NO Ti | 920 | 690 | B |
| 11 | NO Ti | 920 | 690 | C |
| 12 | NO Ti | 920 | 690 | D |
| 13 | NO Ti | 1020 | 660 | A |
| 14 | NO Ti | 1020 | 660 | B |
| 15 | NO Ti | 1020 | 660 | C |
| 16 | NO Ti | 1020 | 660 | D |
| 17 | With Ti | 920 | 630 | E |
| 18 | With Ti | 920 | 630 | F |
| 19 | With Ti | 920 | 630 | G |
| 20 | With Ti | 920 | 660 | E |
| 21 | With Ti | 920 | 660 | F |
| 22 | With Ti | 920 | 660 | G |
| 23 | With Ti | 1020 | 690 | E |
| 24 | With Ti | 1020 | 690 | F |
| 25 | With Ti | 1020 | 690 | G |
| 26 | With Ti | 1020 | 630 | E |
| 27 | With Ti | 1020 | 630 | F |
| 28 | With Ti | 1020 | 630 | G |

SEAMLESS STEEL TUBE WHICH IS INTENDED TO BE USED AS A GUIDE PIPE AND PRODUCTION METHOD THEREOF

FIELD OF THE INVENTION

The present invention refers to steel with good mechanical strength, good toughness and which is corrosion resistant, more specifically to heavy gauge seamless steel tubing, with good mechanical strength, good toughness to prevent cracking in the metal base as well as in the heat affected zone, and corrosion resistant, called conduit, of catenary configuration, to be used as a conduit for fluids at high temperatures, preferably up to 130° C. and high pressure, preferably up to 680 atm and a method for manufacturing said tubing.

BACKGROUND OF THE INVENTION

In the exploitation of deep sea oil reserves, fluid conduits called conduits of catenary configuration, commonly know in the oil industry as Steel Catenary Risers are utilized. These conduits are placed at the upper part of the underwater structure, that is, between the water surface and the first point at which the structure touches the sea bed and is only one part of the complete conduction system.

This canalization system is essentially made up of conduit tubes, which serve to carry the fluids from the ocean floor to the ocean surface. At present this tubing is made of steel and is generally joined together through welding.

There are several possible configurations for these conduits one of which is the asymmetric catenary configuration conduit. Its name is due to the curve which describes the conducting system which is fixed at both ends (the ocean bottom and the ocean surface) and is called a catenary curve.

A conduit system such as the one described above, is exposed to the undulating movements of the waves and the ocean currents. Therefore the resistance to fatigue is a very important property in this type of tubing, making the phenomena of the welded connections of the tubing a critical one. Therefore, restricted dimensional tolerances, mechanical properties of uniform resistance and high tenacity to prevent cracking in the metal base as well as in the heat affected zone, are the principle characteristics of this kind of tubing.

At the same time, the fluid which circulates within the conduit may contain $H_2S$, making it also necessary for the product to be highly resistant to corrosion.

Another important factor that should be taken into account is that the fluid which will be carried by the conduit is very hot, making it necessary for the tubes that make up the system to maintain their properties at high temperatures.

Also, the medium in which the tubes must sometimes operate implies maintaining its operability even at very low temperatures. Many of the deposits are located at latitudes with very low temperatures, making it necessary for the tubing to maintain its mechanical properties even at these temperatures.

Because of the afore described concepts and due to the exploitation of reserves at greater depths, the oil industry has found it necessary to use alloys of steel which allow for the obtaining of better properties than those used in the past.

A common practice used to increase the resistance of a steel product is to add alloying elements such as C and Mn, to carry out a thermal treatment of hardening and tempering and to add elements which generate hardening through precipitation such as Nb and V. However, the type of steel products such as conduits not only require high resistance and toughness, but also other properties such as high resistance to corrosion, and high resistance to cracking in the metal base as well as in the heat affected zone once the tubing has been welded.

It is a well known fact that the betterment in some of the properties of steel means determents in other properties, making the challenge to be met the obtaining of a material which provides an acceptable balance among the various properties.

Conduits are tubes that, like conduit tubing, carry a liquid, a gas or both. Said tubing is manufactured under norms, standards, specifications and codes which govern the manufacturing of conduction tubes in most cases. Additionally, this tubing characterized and differentiated from the majority of standard conduction tube in terms of the range of chemical composition, the range of restricted mechanical properties (yielding, stress resistance and their relationship), low hardness, high toughness, dimensional tolerances restricted by the interior diameter and criteria of severe inspection.

The design and manufacturing of steel used in heavy gauge tubing, presents problems not found in the manufacturing of tubes of lesser gauge, such as the obtaining of the correct hardening, a homogeneous mixture of the properties throughout the thickness and a homogeneous thickness throughout the tube and a reduced eccentricity.

Still another more complex problem is the manufacturing of heavy gauge tubing which fulfills the correct balance of properties required for its performance as a conduit.

In the state of the art, for the manufacturing of tubing to be used as conduits, we may refer to the document EP 1182268 of MIYATA Yukio and associates, which discloses an alloy of steel used for manufacturing conduction or conduit tubing.

In this document the effects of the following elements are disclosed: C, Mo, Mn, N, Al, Ti, Ni, Si, V, B and Nb. Said document indicates that where the contents of carbon is greater than 0.06%, steel becomes susceptible to cracking and fissures during the tempering process.

This is not necessarily valid, since even in heavy gauge tubes, and maintaining the rest of the chemical composition the same, no cracking is observed up to carbon contents of 0.13%.

Furthermore, upon trying to reproduce the teachings of MIYATA and associates, it may be concluded that a material with a maximum range of carbon of 0.06% could not be used for the manufacturing of heavy gauge conduit since C is the main element which promotes the hardenability of the material and it would prove very costly to reach the high resistance required through the addition of other kinds of elements such as Molybdenum which also promotes, given a certain content, detriment in the toughness of the metal base as well as in the heat affected zone and Mn which promotes problems of segregation as we shall see in more detail later on. If the content of carbon is very low, the hardenability of the steel is affected considerably and therefore a thick heterogeneous a circular structure in the half-value layer of the tube would be produced, deteriorating the hardenability of the material as well as producing an inconsistency in the uniformity of resistance in the half-value layer of the tubing.

Furthermore, in the MIYATA and associates document, it is shown that the content of Mn improves the toughness of the material, in the base material as well as in the welding heat affected zone. This affirmation is also incorrect, since Mn is an element which increases the hardenability of steel, thus promoting the formation of martensite, as well as promoting the constituent MA, which is a detriment to toughness. Mn promotes high central segregation in the steel bar from which tubing is made, even more in the presence of P. Mn is the element with the second highest index of segregation, and promotes the formation of MnS inclusions, and even when steel is treated with Ca, due to the problem of central segregation of Mn above 1.35%, said inclusions are not eliminated.

With contents of over 1.35% Mn a significant negative influence is observed in the susceptibility to hydrogen induced cracking known as HIC. Therefore, Mn is the element with the second most influence on the formula CE (Carbon equivalent, formula 11W), with which the value of the content of final CE increases. High contents of CE imply welding problems with the material in terms of hardness. On the other hand, it is know that additives of up to 0.1% of V allow for the obtaining of sufficient resistance for this grade of heavy gauge tubes, although it is impossible to also obtain at the same time high toughness.

One known way in which said tubes are manufactures is through the process of pilger mill lamination. If it is true that by way of this process high gauges of tubes may be obtained, it is also true that good quality in the surface finish of the tube is not obtained. This is because the tube being processed through pilger mill lamination acquires an undulated and uneven outer surface. These factors are prejudicial since they may lessen the collapse resistance which the tube must possess.

On the other hand, the coating of tubes which do not have a smooth outer surface is complicated, and also the inspection for defects with ultrasound becomes inexact.

Steel which may be used to manufacture tubes for conduction systems with catenary configurations, heavy gauges, high stress resistance and low hardenability, and which complies with the requirements of toughness to fissures and resistance to the propagation of fissures in the heat affected zones (HAZ), and resistance to corrosion, necessary for these types of applications has yet to be invented since without the quality of heavy gauges, the simple chemical composition and heat treatment do not allow for the obtaining of the characteristics necessary for this type of product.

The precedents which have been analyzed indicate that the problem has not yet been integrally resolved, and that it is necessary to analyze other parameters and possible solutions in order to reach a complete understanding.

OBJECTIVE OF THE INVENTION

The main objective of this invention is to provide a chemical composition for steel to be used in the manufacturing of seamless steel tube and a process for manufacturing which leads to a product with high mechanical resistance at room temperature and up to 130° C., high toughness, low hardenability, resistance to corrosion in medium's which contain $H_2S$ and high values of tenacity in terms of resistance to the advancing of fissures in the HAZ evaluated by the CTOD test (Crack Tip Opening Displacement).

Still another objective is to make possible a product which possesses an acceptable balance of the above mentioned qualities and which complies with the requirements which a conduit for carrying fluids under high pressure, that is, above 680 atm, should have.

Still another objective is to make possible a product which possesses a good degree of resistance to high temperatures. A fourth objective is to provide a heat treatment to which a seamless tube would be submitted which promotes the obtaining of the necessary mechanical properties and resistance to corrosion.

Other objectives and advantages of the present invention will become apparent upon studying the following description and through the examples shown in the present description, which a-re of an illustrative but not limiting character.

BRIEF DESCRIPTION OF THE INVENTION

Specifically, the present invention consists of, in one of its aspects, mechanical steel, highly resistant to temperatures from room -temperature to 130° C., with good toughness and low hardenability which also is highly resistant to corrosion and cracking in HAZ once the tube is welded to another tube to be used in the manufacturing of steel tubing which complies with underwater conduit systems.

Another aspect of this invention is a method for manufacturing this type of tubing.

With respect to the method, first an alloy is manufacture d with the desired chemical composition. This steel should contain percentages by weight of the following elements in the quantities described: C 0.06 to 0.13; Mn 1.00 to 1.30; Si 0.35 max.; P 0.015 max.; S 0.003 max.; Mo 0.10 to 0.20; Cr 0.10 to 0.30; V 0.050 to 0.10; Nb 0.020 to 0.035; Ni 0.30 to 0.45; Al 0.015 to 0.040; Ti 0.020 max.; Cu 0.2 max. and N 0.010 max.

In order to guarantee a satisfactory hardenability of the material and good weldability, the aforementioned elements should satisfy the following relationships:

$$0.5<(Mo+Cr+Ni)<1$$

$$(Mo+Cr+V)/5+(Ni+Cu)/15\leqq 0.14$$

Steel thus obtained is solidified in blooms or bars which are then perforated and laminated into a tubular shape. The master tube is then adjusted to the final dimensions.

In order to comply completely with the objectives planned for in the present invention, aside from the already defined chemical objectives, it has been determined that the gauge of the walls of the tubes should be established in the range of ≧30 mm.

Next the steel tube is subjected to a thermal hardening and tempering treatment to bestow it with a microstructure and final properties.

BRIEF DESCRIPTION OF THE DRAWINGS

FIG. 3 is a reference for a better understanding of FIG. 2, where the different temperatures of Austenticizing (Aust) and Tempering (Temp) used for each steel with or without the addition of Ti can be seen.

Figure 2:
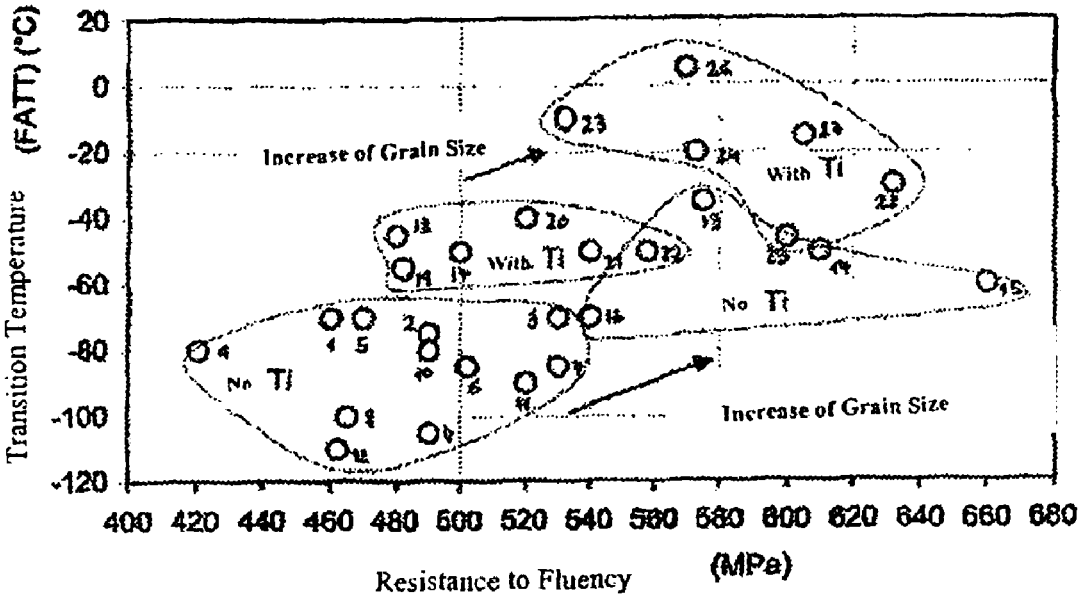
FIG. 2 shows the effect of different temperatures of austenticizing and tempering and the addition or not of Ti, on the Yielding Strength and the transition temperature (FATT), measured in ° C., of different alloys. The chemical composition of the different alloys that were analyzed can be seen in Table 2.

Thus, the steel identified in FIG. 2 with the number 1, possesses 0.001% Ti and has been austenticized at 920° C. and tempered at 630° C. This steel contains the chemical composition A, indicated in Table 2.

Steel 17 (with chemical composition E) contains a larger amount of Ti (0.015%) and has been heat treated under the same conditions as the previously mentioned steel.

In turn, the alloys A, B, C, D, E, F and G have also been treated with other austenticizing and tempering temperatures, as indicated in FIG. 3.

DETAILED DESCRIPTION OF THE INVENTION

The inventor has discovered that the combination of elements such as Nb—V—Mo—Ni—Cr among others, in predetermined amounts, leads to the obtaining of an excellent combination of stress resistance, toughness, hardenability, high levels of CTOD and good resistance to hydrogen induced cracking (HIC) in a metal base, as well as leading to the obtaining of high levels of CTOD in the heat affected zone (HAZ) of the welded joint.

In turn, the inventor has discovered that this chemical composition allows for the elimination of the problems that occur in the manufacturing of high gauge conduits with the above presented characteristics.

Different experiments were carried out in order to discover the best chemical composition of steel that would fulfill the above mentioned requirements. One of these consisted of the manufacturing of high gauge pieces with different alloying additives and then measuring the relation between the Yielding Strength/Ultimate Tensile Strength of each one.

Figure 1:
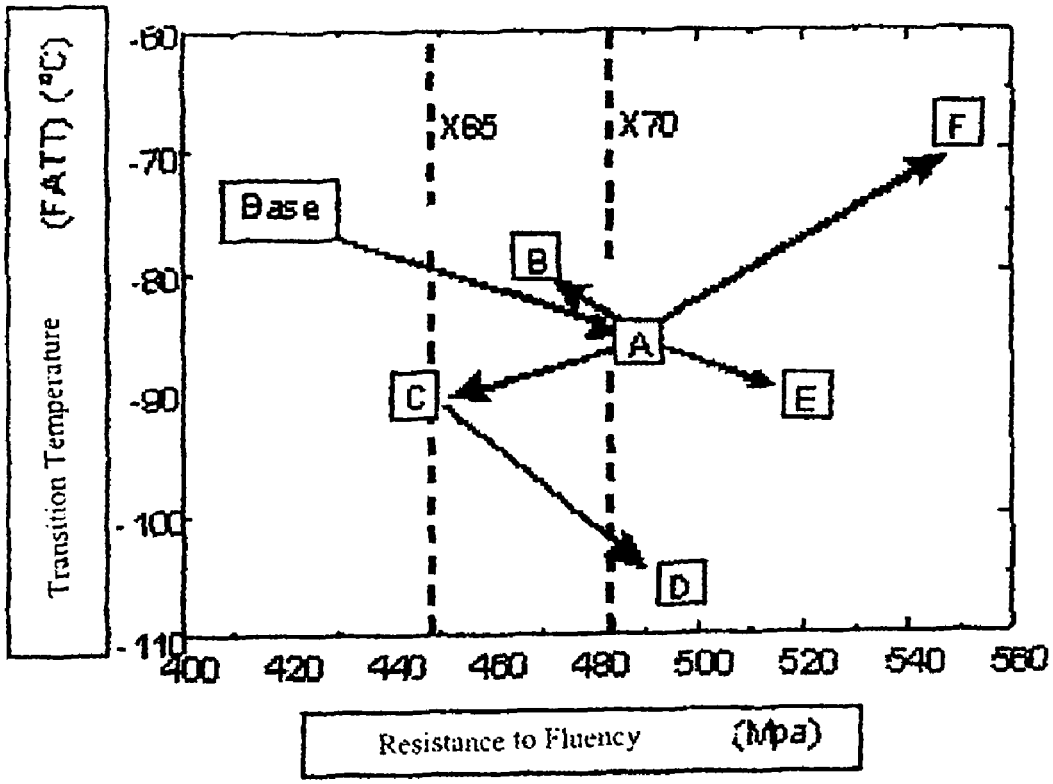
FIG. 1 shows the Yielding Strength measured in Ksi and the transition temperature (FATT), measured in ° C., of various different steels designed by the inventor, used in the manufacturing of conduits. The chemical composition of the "BASE" alloys, "A", "B", "C", "D", "E", and "F", may be seen in Table 1.

The results of these experiments can be seen in FIG. 1. As a starting point a "BASE" alloy with the chemical composition shown in Table 1 with the name "BASE" was used. It was proven that these properties could be improved through the addition of Mo and Ni to the alloy (Steel A).

The next step was to reduce the content of C to 0.061% (Steel B), observing that there was detriment to both values that were evaluated. Once again we started with Steel A, and V was eliminated from the composition (Steel C). In this case, the transition temperature improves slightly, but the Ultimate Tensile Strength of the material did not reach the minimum requirement.

The next step was to experiment with the additive Cr. Cr was added to Steel A (resulting in Steel D), as well as to Steel C (resulting in Steel E). Both steels showed improvements in stress resistance as well as in the transition temperature, although Steel D better met the required standards.

It was thus concluded that the best combination of resistance/transition temperature was obtained with the chemical composition of Alloy D.

On successive occasions, the inventor has carried out other series of experiments to test three important factors which may affect the properties of the material used for the conduit: the content of Ti in an alloy, the effect of the size of the authentic grain and the tempering temperature during the thermal treatment of the steel.

The inventor discovered that the increase in size in the dimension of the authentic grain from 12 microns to 20 microns produces an increase in the resistance of the steel, but at the same time worsens the factor of transition temperature. At the same time it as discovered that the addition of Ti to the alloy negatively affects the transition temperature.

On the other hand, the inventor discovered that the variation in the tempering temperature of steel by approximately 30° C. produced no significant effect on the mechanical properties of the material, in the case of the alloy which did not contain Ti. However, in an alloy with a content of Ti of up to 0.015%, a lowering in the resistance was found when the tempering temperature was increased from 630° to 660° C.

In FIG. 2 the results of the tests may be seen. Four different casts were made with steel without Ti whose chemical composition is described in Table 2 with the letters A, B, C and D. Then three additional casts were made with chemical compositions similar to the previous ones but with the addition of Ti. The chemical composition of the casts is described in Table 2 with the letters E, F and G.

It was observed that, with the addition of Ti to steels A, B, C and D, without taking into account the austenticizing and tempering temperatures to which they were subjected, there were negative results in the transition temperature, as shown in the properties of steel E, F and G which contain Ti. In the same figure it can be seen that the steel without Ti has a lower transition temperature than the steels to which Ti has been added.

Following is the range of chemical compositions which were found to be optimum and which were used in the present invention C 0.06 to 0.13

Carbon is the most economical element and that with the greatest impact on the mechanical resistance of steel, thus the percentage of its content cannot be too low. In order to obtain yielding strength ≧65 Ksi, it is necessary that the content of carbon be above 0.6% for heavy gauge tubes.

In addition, C is the main element which promotes the hardenability of the material. It the percentage of C is too low, the hardenability of the steel is affected considerably and thus the tendency of the formation of a coarse acicular structure in the half-value layer of the tube will be characteristic. This phenomenon will lead to a less than desirable resistance for the material as well as resulting in detriment to the toughness.

The content of C should not be above 0.13% in order to avoid a high degree of high productivity and low thermal hardening in the welding in the joint between one tube and another, and to avoid that the testing values of CTOD (carried out according to the. ASTM norm E 1290) in the metal base exceed 0.8 mm at up to −40° C. and to avoid that they exceed 0.5 mm at up to 0° C. in the HAZ. Therefore, the amount of C should be between 0.06 and 0.13%.

Mn 1.00 to 1.30

Mn is an element which increases the hardenability of steel, promoting the formation of martensite, as well as promoting the constituent MA, which is detrimental to the toughness. Mn promotes a high central segregation in the steel bar from which the tube is laminated. Also, Mn is the element with the second highest index of segregation, promoting the formation of MnS inclusions and even when steel is treated with Ca, due to the problem of central segregation due to the amount of Mn above 1.35%, said inclusions are not eliminated.

On the other hand, with amounts of Mn above 1.35% a significant negative influence is seen in the susceptibility to hydrogen induced cracking (HIC), due to the previously described formation of MnS.

Mn is the second most important element influencing the formula of CE (Carbon equivalent, Formula 11W), with which the end CE value is increased.

A minimum of 1.00% of Mn must be insured and a combination with C in the ranges previously mentioned will guarantee the necessary hardenability of the material in order to meet The resistant requirements.

Therefore, the optimum content of Mn should be in the range of 1.00 to 1.35 and more specifically should be in the range of 1.05 to 1.30%.

Si 0.35 Max.

Silicon is necessary in the process of steel manufacturing as a desoxidant and is also necessary to better stress resistance in the material. This element, like manganese, promotes the segregation of P to the boundaries of the grain; therefore it proves harmful and should be kept at the lowest possible level, preferably below 0.35% by weight.

P 0.015 Max.

Phosphorus is an inevitable element in metallic load, and an amount above 0.015% produces segregation on the boundaries of the grain, which lowers the resistance to HIC. It is imperative to keep the levels below 0.015% in order to avoid problems of toughness as well as hydrogen induced cracking.

S 0.003 Max.

Sulfur, in amounts above 0.003%, promotes, together with high concentrates of Mn, the formation of elongated MnS type inclusions. This kind of sulphide is detrimental to the resistance to corrosion of the material in the presence of $H_2S$.

Mo 0.1 to 0.2

Molybdenum allows for a rise in the tempering temperature, and also prevents the segregation of fragilizing elements on the boundaries of the authentic grain.

This element is also necessary for the improvement of the tempering of the material. It was discovered that the optimum minimal amount should be 0.1%. A maximum of 0.2% is established as an upper limit since above this amount, a decrease in the toughness of the body of the tube as well as in the heat affected zone of the welding is seen.

Cr 0.10 to 0.30

Chromium produces hardening through solid solution and increases the hardenability of the material, thus increasing its stress resistance. Cr is an element which also is found in the chemical makeup. That is why it is necessary to have a minimum amount of 0.10%, but, parallelly, an excess can cause problems of impairment. Therefore it is recommendable to keep the maximum amount at 0.30%.

V 0.050 to 0.10

This element precipitates in a solid solution as carbides and thus increases the material's stress resistance, therefore the minimum amount should be 0.050%. If the amount of this element exceeds 0.10% (and even if it exceeds 0.08%) the tensile strength of the welding can be affected due to an excess of carbides or carbonitrides in the mould. Therefore, the amount should be between 0.050 and 0.10%.

Nb 0.020 to 0.035

This element, like V, precipitates in a solid solution in the form or carbides or nitrides thus increasing the material's resistance. Also, these carbides or nitrides deter excessive growth of the grain. An excess amount of this element has no advantages and actually could cause the precipitation of compounds which can prove harmful to the toughness. That is why the amount of Nb should be between 0.020 and 0.035.

Ni 0.30 to 0.45

Nickel is an element which increases the toughness of the base material and the welding, although excessive additions end up saturating this effect. Therefore the optimum range for heavy gauge tubes should be 0.30 to 0.45%. It has been found that the optimum amount of Ni is 0.40%.

Cu 0.2 Max.

In order to obtain a good weldability of the material and to avoid the appearance of defects which could harm the quality of the joint, the amount of Cu should be dept below 0.2%.

Al 0.015 to 0.040

Like Si, Aluminum acts as a deoxidant in the steel manufacturing process. It also refines the grain of the material thus allowing for higher toughness values. On the other hand, a high Al content could generate alumina inclusions, thus decreasing the toughness of the material. Therefore, the amount of Aluminum should be limited to between 0.015 and 0.040%.

Ti 0.020 Max.

Ti is an element which is used for deoxization and to refine grains. Amounts larger than 0.020% and in the presence of elements such as N and C may form compounds such as carbonitrides or nitrides of Ti which are detrimental to the transition temperature.

As seen in FIG. 2, it was proven that in order to avoid a marked decrease in the transition temperature of the tube, the amount of Ti should be no greater than 0.02%.

N 0.010 Max.

The amount of N should be kept below 100 ppm in order to obtain steel with an amount of precipitates which do not decrease the toughness of the material.

The addition of elements such as Mo, Ni and Cr allow for the development after tempering of a lower bainite microstructure polygonal ferrite with small regions of martensite high in C with retained austenite (MA constituent) dispersed in the matrix.

In order to guarantee a proper hardenability of the material, and good weldability, the elements described below should keep the relationship shown here:

$$0.5<(Mo+Cr+Ni)<1;$$

$$(Mo+Cr+V)/5+(Ni+Cu)/15\leqq 0.14.$$

It was also found that the size of the optimum authentic grain is form 9 to 10 according to ASTM.

The inventor discovered that the chemical composition described lead to the obtaining of an adequate balance of mechanical properties and corrosion resistance, which allowed the conduit to meet the functional requirements.

Since an improvement of certain properties in steel implies a detriment to others, it was necessary to design a material which at the same time allowed for compliance with high stress resistance, good toughness, high CTOD values and high resistance to corrosion in the metal base and high resistance to the advancement of cracking in the zone affected by heat (HAZ).

Preferably, the heavy gauge seamless steel tube containing the detailed chemical composition should have the following balance of characteristic values:

Yielding Strength (YS) at room temperature≧65 Ksi

Yielding Strength (YS) at 130° C.≧65 Ksi

Ultimate Tensile Strength (UTS) at room temperature≧77 Ksi

Ultimate Tensile Strength (UTS) at 130° C.≧77 Ksi

Elongation of 2"≧20% minimum

Relation YS/UTS≦0.89 maximum

Energy absorbed measured at a temperature of −10° C.≧100 Joules minimum

Shear Area (−10° C.)=100%

Hardness≦240 HV10 maximum

CTOD in the metal base (tested at a temperature of up to −40° C.)≧0.8 mm minimum CTOD in the heat affected zone (HAZ) (tested at a temperature of 0° C.)≧0.50 mm Corrosion test HIC, according to NACE TM0284, with solution A: CTR 1.5% Max.; CLR 5.0% Max.

Another aspect of the present invention is that of disclosing the heat treatment suitable for use on a heavy gauge tube with the chemical composition indicated above, in order to obtain the mechanical properties and resistance to corrosion which are required.

The manufacturing process and specifically the parameters of the heat treatment together with the chemical composition described, have been developed by the inventor in order to obtain a suitable relationship of mechanical properties and corrosion resistance, at the same time obtaining high mechanical resistance of the material at 130° C.

The following steps constitute the process for manufacturing the product:

First an alloy with the indicated chemical composition is manufactured. This steel, as has already been mentioned, should contain a percentage by weight of the following elements in the amounts described: C 0.06 to 0.13; Mn 1.00 to 1.30; Si 0.35 Max.; P 0.015 Max.; S 0.003 Max.; Mo 0.10 to 0.20; Cr 0.10 to 0.30; V 0.050 to 0.10; Nb 0.020 to 0.035; Ni 0.30 to 0.45; Al 0.015 to 0.040; Ti 0.020 Max.; Cu 0.2 Max. and N 0.010 Max.

Additionally, the amount of these elements should be such that they meet the following relationship:

$$0.5<(Mo+Cr+Ni)<1;$$

$$(Mo+Cr+V)/5+(Ni+Cu)/15\leqq 0.14.$$

This steel is shaped into solid bars obtained through curved or vertical continuous casting. Next the perforation of the bar and its posterior lamination takes place ending with the product in its final dimensions.

In order to obtain good eccentricity, satisfactory quality in the surface of the outside wall of the tube and good dimensional tolerances, the preferred lamination process should be by still mandrel.

Once the tube is conformed, it is subjected to heat treatment. During this treatment the tube is first heated in an authentic furnace to a temperature above Ac3. The inventor has found that for the chemical composition described above, an authentic temperature of between 900 and 930° C. is necessary. This range has been developed to be sufficiently high as to obtain the correct dissolution of carbides in the matrix and at the same time not so high as to inhibit the excessive growth of the grain, which would later be detrimental to the transition temperature of the tube.

On the other hand, high authentic temperatures above 930° C. could cause the partial dissolution of the precipitates of Nb (C, N) effective in the inhibition of the excessive growth of the size of the grain and detrimental to the transition temperature of the tube.

Once the tube exits the austenitic furnace, it is immediately subjected to exterior-interior tempering in a tub where the quenching agent is water. The quenching should take place in a tube which allows for the rotation of the tube while it is immersed in water, in order to obtain a homogeneous structure throughout the body of the tube preferentially. At the same time, an automatic alignment of the tube with respect to the injection nozzle of water also allows for better compliance with the planned objectives.

The next step is the tempering treatment of the tube, a process which assures the end microstructure. Said microstructure will give the product its mechanical and corrosion characteristics.

It has been found that this heat treatment together with the chemical composition revealed above provide for a matrix of refined bainite with a low C content with small areas, if they are still present, of well dispersed MA constituents, this being advantageous for obtaining the properties that steel for conduit requires. The inventor has found that, to the contrary, the presence of MA constituents in large numbers and of precipitates in the matrix and the boundaries of the grain, is detrimental to the transition temperature.

A high tempering temperature is effective in increasing the toughness of the material since it releases a significant amount of residual forces and places some constituents in the solution.

Therefore, in order to obtain the yielding strength required for this material after the tempering, it is necessary to maintain the fraction de polygonal ferrite low, preferably below 30% and to mainly promote the presence of inferior bainite.

In compliance with the above and in order to reach the necessary balance in the properties of the steel, the tempering temperature should be between 630° C. and 690° C.

It is known that, depending on the chemical composition that the steel possesses, the parameters for the thermal treatment and fundamentally the authentic and tempering temperatures should be determined. Consequently, the inventor found a relationship which makes it possible to determine the optimal tempering temperature, depending on the chemical composition of the steel. This temperature is established according to the following relationship:

$$T_{temp}\,(°\,C.)=[-273+1000/(1.17-0.2\,C-0.3\,Mo-0.4\,V)]\pm 5$$

Following is a description of the best method for carrying out the invention.

The metallic load is prepared according to the concepts described and is cast in an electric arc furnace. During the fusion stage of the load at up to 1550° C. dephosphorization of the steel takes place, next it is descaled and new scale is formed in order to somewhat reduce the sulfur content. Finally it is decaburized to the desired levels and the liquid steel is emptied into the crevet.

During the casting stage, aluminum is added in order to de-oxidize the steel and also an estimated amount of ferro-alloys are added until it reaches 80% of the end composition. Next de-sulfurization takes place; the casting is adjusted in composition as well as temperature; and the steel is sent to the vacuum degassing station where reduction of gases (H, N, O and S) takes place; and finally the treatment ends with the addition of CaSi to make inclusions float.

Once the casting material is prepared in composition and temperature, it is sent to the continuous casting machine or the ingot casting where the transformation from liquid steel to solid bars of the desired diameter takes place. The product obtained on completion of this process is ingots, bars or blossoms having the chemical composition described above.

The next step is the reheating of the steel blossoms to the temperature necessary for perforation and later lamination. The master tube thus obtained is then adjusted to the final desired dimensions.

Next the steel tube is subjected to a hardening and tempering heat treatment in accordance with the parameters described in detail above.

EXAMPLES

Following are examples of the application of the present invention in table form.

Table 3 presents the different chemical compositions on which the tests used to consolidate this invention were based. Table 4 establishes the effect of this composition, with the heat treatments indicated, on the mechanical and anti-corrosion properties of the product. For example, the conduit identified with the number 1 has the chemical composition described in Table 3, that is: C, 0.09; Mn, 1.16; Si, 0.28; P. 0.01; S, 0.0012; Mo, 0.133; Cr, 0.20; V, 0.061; Nb, 0.025; Ni, 0.35; Al, 0.021; Ti, 0.013; N, 0.0051: Mo +Cr +Ni 0.68 and (Mo+Cr+V)/5+(Ni+Cu)/15=0.10.

At a given moment, this same material is subjected to a heat treatment as indicated in columns "T.Aust." Y "T. Temp" in Table 4, that is, an authentic Temperature: T. Aust=900° C. and a Tempering Temperature: T. Temp.=650° C.

This same tube possesses the properties indicated in the following columns for the same steel number as in Table 4, that is, a thickness of 35 mm, a yielding strength (YS) of 75 Ksi, an ultimate tensile strength (UTS) of 89 Ksi, a relation between the yielding strength and the ultimate tensile strength (YS/UTS) of 0.84, a yielding strength measured at 130° C. of 69 Ksi, an ultimate tensile strength measured at 130° C. of 82 Ksi, a relationship between the yielding strength and the ultimate tensile strength measured at 130° C. of 0.84, a resistance to cracking measured by the CTOD test at −10° C. of 1.37 mm, a measurement of absorbed energy measured by the Charpy test at −10° C. of 440 Joules, a ductile/brittle area of 100%, a hardness of 215 HV10 and corrosion resistance measured by the HIC test in accordance with the NACE TM0284, with solution A of Norm NACE TM0177 1.5% being the maximum for CTR and 5.0% being the maximum for CLR.

TABLE 1

Chemical composition of the steels shown in FIG. 1

| Steel | C | Si | Mn | P | S | Al | N | Nb | V | Ti | Cr | Ni | Cu | Mo |
|---|---|---|---|---|---|---|---|---|---|---|---|---|---|---|
| Base | 0.089 | 0.230 | 1.29 | 0.007 | 0.0014 | 0.022 | 0.0030 | 0.028 | 0.050 | 0.0012 | 0.070 | 0.010 | 0.12 | 0.002 |
| A | 0.083 | 0.230 | 1.28 | 0.007 | 0.0013 | 0.025 | 0.0031 | 0.027 | 0.050 | 0.0012 | 0.070 | 0.380 | 0.12 | 0.150 |
| B | 0.061 | 0.230 | 1.28 | 0.007 | 0.0011 | 0.025 | 0.0032 | 0.027 | 0.050 | 0.0013 | 0.070 | 0.380 | 0.12 | 0.150 |
| C | 0.092 | 0.230 | 1.29 | 0.007 | 0.0015 | 0.025 | 0.0029 | 0.027 | 0.002 | 0.0013 | 0.067 | 0.384 | 0.12 | 0.150 |
| D | 0.089 | 0.229 | 1.27 | 0.007 | 0.0011 | 0.026 | 0.0028 | 0.027 | 0.002 | 0.0020 | 0.223 | 0.379 | 0.12 | 0.153 |
| E | 0.091 | 0.225 | 1.27 | 0.007 | 0.0012 | 0.023 | 0.0035 | 0.027 | 0.050 | 0.0013 | 0.220 | 0.380 | 0.11 | 0.150 |
| F | 0.130 | 0.230 | 1.28 | 0.007 | 0.0014 | 0.025 | 0.0031 | 0.027 | 0.050 | 0.0013 | 0.067 | 0.383 | 0.11 | 0.153 |

TABLE 2

Chemical composition of steels shown in FIG. 2.

| Steel | C | Si | Mn | P | S | Al | N | Nb | V | Ti | Cr | Ni | Cu | Mo |
|---|---|---|---|---|---|---|---|---|---|---|---|---|---|---|
| A | 0.09 | 0.23 | 1.3 | 0.01 | 0.001 | 0.023 | 0.003 | 0.03 | 0.05 | 0.001 | 0.068 | 0.01 | 0.11 | 0.15 |
| B | 0.08 | 0.23 | 1.3 | 0.01 | 0.001 | 0.025 | 0.003 | 0.03 | 0.05 | 0.001 | 0.070 | 0.38 | 0.12 | 0.15 |
| C | 0.09 | 0.23 | 1.3 | 0.01 | 0.001 | 0.023 | 0.004 | 0.03 | 0.05 | 0.001 | 0.220 | 0.38 | 0.11 | 0.15 |
| D | 0.09 | 0.23 | 1.3 | 0.01 | 0.001 | 0.026 | 0.003 | 0.03 | 0.05 | 0.002 | 0.223 | 0.38 | 0.12 | 0.15 |
| E | 0.09 | 0.22 | 1.3 | 0.01 | 0.001 | 0.024 | 0.005 | 0.03 | 0.05 | 0.015 | 0.065 | 0.01 | 0.11 | 0.15 |
| F | 0.09 | 0.22 | 1.3 | 0.01 | 0.001 | 0.022 | 0.005 | 0.03 | 0.05 | 0.014 | 0.065 | 0.38 | 0.11 | 0.15 |
| G | 0.09 | 0.22 | 1.3 | 0.01 | 0.001 | 0.022 | 0.005 | 0.03 | 0.05 | 0.015 | 0.220 | 0.37 | 0.12 | 0.15 |

TABLE 3

Examples of chemical composition of the present invention

| Steel | C | Mn | Si | P | S | Mo | Cr | V | Nb | Ni | Al | Ti | N | Mo + Cr + Ni | (Mo + Cr + V)/5 + (Ni + Cu)/15 |
|---|---|---|---|---|---|---|---|---|---|---|---|---|---|---|---|
| 1 | 0.09 | 1.16 | 0.28 | 0.01 | 0.001 | 0.13 | 0.20 | 0.061 | 0.025 | 0.35 | 0.021 | 0.0130 | 0.0051 | 0.68 | 0.10 |
| 2 | 0.11 | 1.12 | 0.30 | 0.011 | 0.003 | 0.14 | 0.14 | 0.054 | 0.023 | 0.41 | 0.025 | 0.0030 | 0.0056 | 0.69 | 0.09 |
| 3 | 0.10 | 1.13 | 0.30 | 0.010 | 0.002 | 0.14 | 0.14 | 0.056 | 0.024 | 0.42 | 0.026 | 0.0030 | 0.0043 | 0.70 | 0.10 |
| 4 | 0.11 | 1.13 | 0.29 | 0.013 | 0.002 | 0.14 | 0.11 | 0.063 | 0.030 | 0.42 | 0.026 | 0.0020 | 0.0060 | 0.67 | 0.09 |
| 5 | 0.10 | 1.12 | 0.29 | 0.012 | 0.003 | 0.14 | 0.12 | 0.066 | 0.032 | 0.43 | 0.026 | 0.0020 | 0.0060 | 0.69 | 0.09 |
| 6 | 0.11 | 1.11 | 0.30 | 0.011 | 0.002 | 0.14 | 0.14 | 0.055 | 0.023 | 0.41 | 0.026 | 0.0030 | 0.0058 | 0.69 | 0.09 |
| 7 | 0.10 | 1.14 | 0.29 | 0.012 | 0.003 | 0.14 | 0.11 | 0.063 | 0.030 | 0.42 | 0.025 | 0.0020 | 0.0057 | 0.67 | 0.09 |
| 8 | 0.09 | 1.13 | 0.30 | 0.010 | 0.002 | 0.14 | 0.13 | 0.056 | 0.024 | 0.42 | 0.026 | 0.0030 | 0.0053 | 0.69 | 0.09 |
| 9 | 0.11 | 1.21 | 0.29 | 0.013 | 0.003 | 0.15 | 0.19 | 0.054 | 0.023 | 0.39 | 0.027 | 0.0030 | 0.0058 | 0.73 | 0.10 |
| 10 | 0.11 | 1.21 | 0.29 | 0.014 | 0.002 | 0.14 | 0.18 | 0.054 | 0.028 | 0.39 | 0.026 | 0.0030 | 0.0053 | 0.71 | 0.10 |
| 11 | 0.12 | 1.21 | 0.28 | 0.013 | 0.002 | 0.14 | 0.18 | 0.051 | 0.024 | 0.38 | 0.023 | 0.0020 | 0.0065 | 0.70 | 0.10 |
| 12 | 0.12 | 1.20 | 0.28 | 0.013 | 0.003 | 0.13 | 0.19 | 0.052 | 0.022 | 0.38 | 0.029 | 0.0020 | 0.0067 | 0.70 | 0.10 |

TABLE 4

Examples of the balance of properties of the present invention

| | | Rev. | | Room Temperature | | | 130° C. | | | CTOD | Energy absorbed at −10° C. | | | | |
|---|---|---|---|---|---|---|---|---|---|---|---|---|---|---|---|
| | Aust. T. | T. (*) | Thickness | YS | UTS | YS/UTS | YS | UTS | YS/UTS | at −10° C. | in base metel | Shear Area | Hardness | HIC Test | |
| Steel | ° C. | ° C. | (mm) | Ksi | Ksi | — | Ksi | Ksi | — | (mm) | (Joules) | % | HV10 | CTR | CLR |
| 1 | 900 | 646 | 35 | 75 | 89 | 0.84 | 69 | 82 | 0.84 | 1.37 | 440 | 100 | 215 | 0 | 0 |
| 2 | 900 | 649 | 30 | 81 | 91 | 0.89 | 70 | 83 | 0.84 | 1.39 | 410 | 100 | 202 | 0 | 0 |

TABLE 4-continued

Examples of the balance of properties of the present invention

| Steel | Aust. T. ° C. | Rev. T. (*) ° C. | Thickness (mm) | Room Temperature YS Ksi | Room Temperature UTS Ksi | Room Temperature YS/UTS — | 130° C. YS Ksi | 130° C. UTS Ksi | 130° C. YS/UTS — | CTOD at −10° C. (mm) | Energy absorbed at −10° C. in base metel (Joules) | Shear Area % | Hardness HV10 | HIC Test CTR | HIC Test CLR |
|---|---|---|---|---|---|---|---|---|---|---|---|---|---|---|---|
| 3 | 900 | 648 | 30 | 81 | 91 | 0.89 | 69 | 82 | 0.84 | 1.35 | 405 | 100 | 214 | 0 | 0 |
| 4 | 900 | 652 | 35 | 77 | 89 | 0.86 | 69 | 82 | 0.84 | 1.38 | 390 | 100 | 201 | 0 | 0 |
| 5 | 900 | 652 | 35 | 82 | 92 | 0.89 | 76 | 89 | 0.85 | 1.38 | 380 | 100 | 208 | 0 | 0 |
| 6 | 900 | 650 | 38 | 78 | 92 | 0.85 | 72 | 82 | 0.88 | 1.36 | 400 | 100 | 218 | 0 | 0 |
| 7 | 900 | 651 | 38 | 80 | 90 | 0.89 | 71 | 83 | 0.85 | 1.39 | 410 | 100 | 217 | 0 | 0 |
| 8 | 900 | 646 | 40 | 80 | 90 | 0.88 | 77 | 88 | 0.87 | 1.39 | 407 | 100 | 203 | 0 | 0 |
| 9 | 900 | 652 | 40 | 79 | 89 | 0.88 | 74 | 83 | 0.89 | 1.37 | 425 | 100 | 202 | 0 | 0 |
| 10 | 900 | 649 | 40 | 76 | 87 | 0.87 | 74 | 85 | 0.87 | 1.38 | 419 | 100 | 202 | 0 | 0 |
| 11 | 900 | 650 | 40 | 81 | 91 | 0.89 | 69 | 81 | 0.85 | 1.34 | 423 | 100 | 203 | 0 | 0 |
| 12 | 900 | 648 | 40 | 80 | 91 | 0.88 | 70 | 83 | 0.84 | 1.36 | 393 | 100 | 214 | 0 | 0 |

(*) Defined according to the formula: $T_{temp}$ (° C.) = [−273 + 1000/(1.17 − 0.2 C − 0.3 Mo − 0.4 V)] +/− 5

The invention has been sufficiently described so that anyone with the knowledge in the field can reproduce and obtain the results that we mention in the present invention. However, any person skilled in the art of the present invention is able to carry out modifications not described in the present application, but for the application of these modifications in a determined material or manufacturing process of said, the material claimed in the following Claims is required, said material and said processes are deemed to fall within the board scope and ambit of the invention as herein set forth.

The invention claimed is:

1. A heavy gauge seamless steel pipe characterized by the material of which it is manufactured being made up of basically of Fe and the following chemical composition expressed in % by weight of additional elements:

C 0.06 to 0.13
Mn 1.00 to 1.30
Si 0.35 Max.
P 0.015 Max.
S 0.003 Max.
Mo 0.1 to 0.2
Cr 0.10 to 0.30
V 0.050 to 0.10
Nb 0.020 to 0.035
Ni 0.30 to 0.45
Al 0.015 to 0.040
Ti 0.020 Max.
N 0.010 Max.
Cu 0.2 Max.

and also the chemical composition with the following relation among the alloying elements:

$$0.5<(Mo+Cr+Ni)<1$$

$$(Mo+Cr+V)/5+(Ni+Cu)/15\leqq 0.14;$$

wherein the seamless steel pipe has a microstructure formed by re-heating to an austenitic temperature followed by water quenching and a tempering treatment that results in a microstructure having austenite grains with an average size from ASTM 10 to 20 microns.

2. The seamless steel pipe as in claim 1, also characterized by a Titanium content of no more than 0.002% by weight.

3. The seamless steel pipe as in claim 1, also characterized by the presence of a resistance to cracking measured by the CTOD test at a temperature of −40° C.≧0.8 mm in the metal base and a CTOD test at a temperature of 0° C.≧0.5 mm in a heat affected zone.

4. The seamless steel pipe as in claim 1, characterized by a resistance to corrosion measured by the HIC test in accordance with norm NACE TM0284 with solution A being 1.5% max. for CTR and 5.0% max. for CLR.

5. The seamless steel pipe as in claim 1, characterized by having heavy gauge walls≧30 mm.

6. The seamless steel pipe as in claim 5, characterized by having heavy gauge walls≧40 mm.

7. The seamless steel pipe as in any of the previous claims 1 through 6, characterized by possessing the following properties:

$YS_{Troom}$≧65 Ksi
$YS_{130° C.}$≧65 Ksi
$UTS_{Troom}$≧77 Ksi
$UTS_{130° C.}$≧77 Ksi The energy absorbed was evaluated at a temperature of up to −10° C.≧Joules Hardness≦240 HV10 maximum.

8. The seamless steel pipe as in claim 1, characterized by possessing the following properties:

$YS_{Troom}$≧65 Ksi
$YS_{130° C.}$≧65 Ksi
$UTS_{Troom}$≧77 Ksi
$UTS_{130° C.}$≧77 Ksi
YS/UTS≦0.89
Elongation≧20%

Energy absorbed evaluated at a temperature of up to −20° C.>380 Joules

Shear Area at −10° C. =100%

Hardness≦220 HV10.

9. A process for manufacturing a seamless steel, the process comprising:

manufacturing a steel;
obtaining a solid cylindrical piece from the steel;
perforating said solid cylindrical piece to form a steel pipe;
rolling said steel pipe to form a rolled pipe;
subjecting the rolled pipe to a heat treatment comprising re-heating to a austenitic temperature followed by water quenching and a tempering treatment that results in the seamless steel pipe having a microstructure having austenite grains with an average size from ASTM 10 to 20 microns, wherein said process is characterized by the addition of certain amounts of elements during the manufacturing and the elimination of other elements so as to produce a final composition in % by weight that contains, besides iron and inevitable impurities, the following:

C 0.06 to 0.13
Mn 1.00 to 1.30
Si 0.35 Max.
P 0.015 Max.
S 0.003 Max.
Mo 0.1 to 0.2
Cr 0.10 to 0.30
V 0.050 to 0.10
Nb 0.020 to 0.035
Ni 0.30 to 0.45
Al 0.015 to 0.040
Ti 0.020 Max.
N 0.010 Max.
Cu 0.2 Max.

and also the chemical composition complying with the relationship among the alloying elements:

$$0.5 \leqq (Mo+Cr+Ni) < 1$$

$$(Mo+Cr+V)/5+(Ni+Cu)/15 \leqq 0.14.$$

10. A process for manufacturing seamless steel pipe as claimed in claim 9 characterized by said heat treatment consisting of austenitizing to a temperature of between 900° C. and 930° C., followed by interior-exterior hardening in water and then heat treatment for tempering at a temperature of between 630° C. and 690° C. as defined by the following equation:

$$T_{temp}(°\,C.)=[-273+1000/(1.17-0.2\,C-0.3\,Mo-0.4\,V)]+/-5.$$

11. The seamless steel pipe as in claim 2, also characterized by the presence of a resistance to cracking measured by the CTOD test at a temperature of −40° C.≧0.8 mm in the metal base and a CTOD test at a temperature of O° C.≧0.5 mm in a heat affected zone.

12. The seamless steel pipe as in claim 2, characterized by a resistance to corrosion measured by the HIC test in accordance with norm NACE TM0284 with solution A being 1.5% max. for CTR and 5.0% max. for CLR.

13. The seamless steel pipe as in claim 3, characterized by a resistance to corrosion measured by the HIC test in accordance with norm NACE TM0284 with solution A being 1.5% max. for CTR and 5.0% max. for CLR.

14. The seamless steel pipe as in claim 2, characterized by having heavy gauge walls≧30 mm.

15. The seamless steel pipe as in claim 3, characterized by having heavy gauge walls≧30 mm.

16. The seamless steel pipe as in claim 4, characterized by having heavy gauge walls ≧30 mm.

17. The seamless steel pipe as in claim 2, characterized by possessing the following properties:

$YS_{Troom}$≧65 Ksi
$YS_{130°\,C.}$≧65 Ksi
$UTS_{Troom}$≧77 Ksi
$UTS_{130°\,C.}$≧77 Ksi
YS/UTS≦0.89
Elongation≧20%

Energy absorbed evaluated at a temperature of up to −20° C.>380 Joules
Shear Area at −10° C.=100%
Hardness≦220 HV10.

18. The seamless steel pipe as in claim 3, characterized by possessing the following properties:

$YS_{Troom}$≧65 Ksi
$YS_{130°\,C.}$≧65 Ksi
$UTS_{Troom}$≧77 Ksi
$UTS_{130°\,C.}$≧77 Ksi
YS/UTS≦0.89
Elongation≧20%

Energy absorbed evaluated at a temperature of up to −20° C.≧380 Joules
Shear Area at −10° C.=100%
Hardness≦220 HV10.

19. The seamless steel pipe as in claim 4, characterized by possessing the following properties:

$YS_{Troom}$≧65 Ksi
$YS_{130°\,C.}$≧65 Ksi
$UTS_{Troom}$≧77 Ksi
$UTS_{130°\,C.}$≧77 Ksi
YS/UTS≦0.89
Elongation≧20%

Energy absorbed evaluated at a temperature of up to −20° C.≧380 Joules
Shear Area at −10° C.=100%
Hardness≦220 HV10.

20. The seamless steel pipe as in claim 5, characterized by possessing the following properties:

$YS_{Troom}$>65 Ksi
$YS_{130°\,C.}$>65 Ksi
$UTS_{Troom}$>77 Ksi
$UTS_{130°\,C.}$>77 Ksi
YS/UTS<0.89
Elongation>20%

Energy absorbed evaluated at a temperature of up to −20° C.>380 Joules
Shear Area at −10° C.=100%
Hardness<220 HV10.

21. The seamless steel pipe of claim 1, wherein the seamless steel pipe possesses a lower bainite microstructure, polygonal ferrite below 30% with regions of martensite with retained austenite dispersed in the matrix.

* * * * *

UNITED STATES PATENT AND TRADEMARK OFFICE

CERTIFICATE OF CORRECTION

PATENT NO. : 8,002,910 B2
APPLICATION NO. : 10/554075
DATED : August 23, 2011
INVENTOR(S) : Marco Mario Tivelli et al.

It is certified that error appears in the above-identified patent and that said Letters Patent is hereby corrected as shown below:

At Page 1 (Item 57) (Abstract), Line 9, After "of" delete "an".

At Page 2 (Item 56), Column 2, Line 49, Under Other Publications, change "Newletter" to --Newsletter--.

At Page 2 (Item 56), Column 2, Line 50, Under Other Publications, change "Newletter" to --Newsletter--.

At Page 3 (Item 56), Column 1, Line 43, Under Other Publications, change "Pergamom" to --Pergamon--.

At Page 3 (Item 56), Column 1, Line 49, Under Other Publications, change "artic" to --arctic--.

At Page 3 (Item 56), Column 1, Line 52, Under Other Publications, change "steels"" to --steels",--.

At Page 3 (Item 56), Column 2, Line 4, Under Other Publications, change "Ladislav, ," to --Ladislav,--.

At Page 3 (Item 56), Column 2, Line 25, Under Other Publications, change "Anoxid" to --Anoxic--.

At Page 3 (Item 56), Column 2, Line 29, Under Other Publications, change "Spinger-Verlag," to --Springer-Verlag,--.

At Page 3 (Item 56), Column 2, Line 40, Under Other Publications, change "Geochemica et Cosmochemica" to --Geochimica et Cosmochimica--.

At Page 3 (Item 56), Column 2, Line 59, Under Other Publications, change "Tempuratures"," to --Temperatures",--.

At Page 4 (Item 56), Column 1, Line 1, Under Other Publications, change "Perganom" to --Pergamon--.

Signed and Sealed this
Twenty-seventh Day of March, 2012

David J. Kappos

David J. Kappos
*Director of the United States Patent and Trademark Office*

At Column 1, Line 20, Change “know” to --known--.

At Column 3, Line 50, Change “medium’s” to --mediums--.

At Column 4, Line 2, Change “a-re” to --are--.

At Column 4, Line 8, Change “-temperature” to --temperature--.

At Column 4, Lines 51-52, Change “austenticizing” to --austenitizing--.

At Column 4, Line 58, Change “Austenticizing” to --Austenitizing--.

At Column 4, Line 62, Change “austenticized” to --austenitized--.

At Column 5, Line 2, Change “austenticizing” to --austenitizing--.

At Column 5, Line 50, Change “authentic” to --austenitic--.

At Column 5, Line 53, Change “authentic” to --austenitic--.

At Column 6, Line 6, Change “austenticizing” to --austenitizing--.

At Column 6, Line 15 (Approx.), Change “invention” to --invention:--.

At Column 6, Line 54, Change “11W),” to --IIW),--.

At Column 6, Line 59, Change “The” to --the--.

At Column 6, Line 65, Change “desoxidant” to --deoxidant--.

At Column 7, Line 18, Change “authentic” to --austenitic--.

At Column 8, Line 2, Change “deoxization” to --deoxidation--.

At Column 8, Line 26, Change “authentic” to --austenitic--.

At Column 9, Line 29, Change “authentic” to --austenitic--.

At Column 9, Line 31, Change “authentic” to --austenitic--.

At Column 9, Line 37, Change “authentic” to --austenitic--.

At Column 9, Line 45, Change “a tube” to --a tub--.

At Column 10, Line 10, Change “authentic” to --austenitic--.

At Column 10, Line 26, Change “decaburized” to --decarburized--.

At Column 10, Line 60, Change “P.” to --P,--.

At Column 10, Line 62, Change “Ni 0.68” to --Ni = 0.68--.

At Column 11-12 (Table 4), Line 6 (Approx.), Change “metel” to --metal--.

At Column 13-14 (Table 4 continued), Line 6 (Approx.), Change “metel” to --metal--.

At Column 13, Line 24, After “with” delete “the”.

At Column 13, Line 31, Change “board” to --broad--.

At Column 14, Line 42, In Claim 7, Change “-10° C. ≧Joules” to -- -10° C. ≧100 Joules--.

At Column 14, Line 56, In Claim 9, Change “a seamless steel, the” to --a seamless steel pipe, the--.

At Column 15, Line 39, In Claim 11, Change “O°C.≥0.5” to --0°C.≥0.5--.